US006591891B2

(12) United States Patent
Kanayama et al.

(10) Patent No.: US 6,591,891 B2
(45) Date of Patent: Jul. 15, 2003

(54) METHOD FOR MAKING SAND COVERED WITH BENTONITE, THE SAND, AND A METHOD FOR RECYCLING MOLDING SAND FOR A MOLD USING THE SAND COVERED BY BENTONITE

(75) Inventors: Ryoji Kanayama, Toyokawa (JP); Yasunori Yoshida, Toyokawa (JP); Kuniyasu Mori, Toyokawa (JP); Kazuo Sugimoto, Toyokawa (JP); Yukikazu Ando, Toyokawa (JP)

(73) Assignee: Sintokogio Ltd., Aichi-ken (JP)

( * ) Notice: Subject to any disclaimer, the term of this patent is extended or adjusted under 35 U.S.C. 154(b) by 0 days.

(21) Appl. No.: 10/043,172

(22) Filed: Jan. 14, 2002

(65) Prior Publication Data

US 2002/0110044 A1 Aug. 15, 2002

(30) Foreign Application Priority Data

Jan. 15, 2001 (JP) ..... 2001-005824
Jun. 14, 2001 (JP) ..... 2001-179411
Sep. 25, 2001 (JP) ..... 2001-290720

(51) Int. Cl.[7] ..... B22C 5/00; B22C 1/00; B22C 9/02; B28C 7/04

(52) U.S. Cl. ..... 164/5; 366/6; 366/8; 366/7

(58) Field of Search ..... 366/8, 6, 7; 164/5

(56) References Cited

U.S. PATENT DOCUMENTS 2,958,107 A * 11/1960 Hartley ..... 366/8
3,461,941 A * 8/1969 Schumacher ..... 164/5
3,473,788 A * 10/1969 Kelly ..... 366/8
3,519,252 A * 7/1970 Dietert et al. ..... 366/8
3,604,493 A * 9/1971 Schumacher ..... 164/5
3,762,461 A * 10/1973 Schumacher ..... 164/5
4,137,085 A * 1/1979 Matsui ..... 106/38.35
4,144,088 A * 3/1979 Adams ..... 134/2
4,203,771 A * 5/1980 Matsui ..... 106/38.35
4,449,566 A * 5/1984 Filipovitch et al. ..... 164/5
4,681,267 A * 7/1987 Leidel et al. ..... 164/5
4,952,246 A * 8/1990 Seeley ..... 164/5
5,167,270 A * 12/1992 Henych ..... 164/5
5,211,215 A * 5/1993 Sommer ..... 164/5
5,279,741 A * 1/1994 Schott ..... 164/5
5,439,044 A * 8/1995 Boenisch ..... 164/5
5,526,937 A * 6/1996 Rossmanith ..... 164/5
5,706,879 A * 1/1998 Renner et al. ..... 164/5
5,816,312 A * 10/1998 Suginaka et al. ..... 366/7
5,992,499 A * 11/1999 Tordoff et al. ..... 164/5
6,435,262 B1 * 8/2002 McVane ..... 164/5
6,516,863 B2 * 2/2003 McVane ..... 164/5

* cited by examiner

*Primary Examiner*—Tony G. Soohoo
(74) *Attorney, Agent, or Firm*—Finnegan, Henderson, Farabow, Garrett & Dunner, LLP

(57) ABSTRACT

Given green sand is obtained by a mixing operation that is carried out for a short period of time. Discarded sand is supplied as supplementary sand to a sand processing line, so that molding sand can be recycled. Green sand for a molding is used for facing sand or the pocket sand. Bentonite-covered sand is made by mixing reproduced sand, new sand, and discarded sand or any or all of them. The bentonite-covered sand is added to collected sand to supplement it. Also, the bentonite-covered sand is mixed with water, and used for facing sand or the pocket sand.

16 Claims, 5 Drawing Sheets

METHOD FOR MAKING SAND COVERED WITH BENTONITE, THE SAND, AND A METHOD FOR RECYCLING MOLDING SAND FOR A MOLD USING THE SAND COVERED BY BENTONITE

FIELD OF INVENTION

This invention relates to a method for making sand covered by bentonite by mixing discarded sand, reproduced sand or new sand or some or all of them with bentonite. Also, it relates to the sand and a method for recycling molding sand for a mold using the sand.

BACKGROUND OF INVENTION

FIG. 2 shows a prior-art processing line for green sand. Generally, as shown in the processing line a core or a mold on which sand is attached is transmitted to another line after it is removed from a flask. After green sand is removed from a flask, part of it is transmitted to the sand processing line where it is called collected sand and again used as green sand for a casting. The sand into which a flask is broken is discarded through a collector. Part of the sand, which is discarded through the collector, is collected and used again (not shown).

Generally, a core and green sand that is attached to a mold are discharged from the sand processing line after they are removed from a flask. Also, part of the collected sand is extracted and discarded to prevent unnecessary sand of the core from being mixed with the collected sand, because of the mixing of the sand of the core. Thus, the collected sand decreases as it is sent to the green sand processing line.

Thus, regenerated sand and new sand or one of them is supplied to the green sand processing line to supplement the collected sand, and is mixed with it so that it can be used again as green sand for a molding. Also, during the mixing operation bentonite is supplemented for part of the bentonite that has been inactive because of its burning. Water is also added during that operation.

During the mixing operation of green sand for a mold, generally, active bentonite and water are supplemented so that the active bentonite may be 7~8% of the green sand and the water may be 3~4%. But the amount of water is less than 50% of the active bentonite. Also, the amount of the water in the green sand is never set to more than that amount. Thus, it is desirable that sand particles of green sand for a molding are uniformly coated by bentonite so that each may have a sufficient thickness of bentonite.

However, it is difficult for the mixing operation of the prior-art method to sufficiently cover regenerated sand and new sand or one of them with bentonite for a given period of time. Moreover, a long time is needed to make desirable green sand.

Also, by a prior-art method, part of the discarded sand that is output from the molding sand processing line is used again for sand for a core, and is thus returned to the line. Also, part of the discarded sand is used for subgrades. However, much of the sand is discarded for landfills or waste products. Recently, discarded sand is sometimes processed to be reproduced and returned to the molding line. However, this is not common. In the green sand processing line of the prior art, almost all of the green sand is transmitted to the sand processing line after it is removed from a flask. That sand is called collected sand and is used again as green sand for a mold.

In that case, a core and green sand that is attached to a mold are also discarded. Alternatively, part of the collected sand is discarded, so that the collected sand decreases as it is transmitted along the green sand processing line.

Thus, regenerated sand and new sand or one of them is added to the collected sand in the green sand processing line. During the mixing operation, active bentonite is supplemented for bentonite that is inactive because of its burning. Also, water is added. Thus, a method for recycling green sand is used so that the collected sand can be used again as green sand.

Sand particles for green sand for a mold are needed to uniformly be coated by bentonite so that each has a sufficient thickness of the bentonite. However, it is difficult for the prior-art method using the green sand processing line for recycling green sand to cover the supplementary sand that is added to the collected sand with bentonite so that it may have a given thickness. Thus, it is possible that a mold that does not have any given size or shape could be made. Thus, the available percentage of molds decreases. Also, there are other disadvantages such as that a long time is needed to mix the collected sand and supplementary sand to make given green sand, and such as that the sand that is discarded from the molding sand processing line that includes the green sand processing line cannot be efficiently used. Resource saving and environmental protection cannot be efficiently achieved.

Also, for a common mold, many points, such as the nature of green sand that contacts the surface of a mold, especially; the stability of the surface, the fire resistance, the compression strength, the size of sand particles, etc. must be considered. Substantially the same nature of the green sand is needed for insular parts.

Thus, there is a case when special sand is used for facing sand or sand for a pocket ("pocket sand") that contacts surfaces of a mold or insular parts. The special sand may include synthetic mullite sand, zircon sand, chromite sand, oivine sand, etc. They have some advantages such as that the coefficient of thermal expansion is small, the fire resistance is excellent, and burning can be prevented. The special sand for facing sand and the pocket sand is mixed and processed in a line that differs from the line for common green sand.

However, the special sand is more expensive than common green sand. Also, the special sand for facing sand and the pocket sand differs from green sand that is cycled within the line in that the facing sand and the pocket sand are made by mixing reproduced sand or new sand to which no bentonite has been attached with bentonite. However, it is difficult to cover them with bentonite to have a given thickness. Also, it takes a relatively long time to perform the mixing and processing operations so as to obtain a given nature of green sand.

This invention is conceived to overcome the disadvantages stated above. One of the objects of this invention is to provide sand covered with bentonite and a method for making the sand by adding supplementary sand to collected sand and mixing and processing them in a relatively short time, so that given green sand can be made for a mold.

Another object of this invention is to provide a method for recycling molding sand by mixing discarded sand that is discharged from a line for processing molding sand with bentonite to make sand that is covered by the bentonite, and supplying it as supplementary sand to a line for processing green sand. This method allows the sand that is to be provided to the line for processing green sand to have given natures for a short time. Also, the discarded sand can be effectively used again.

Further, another object of this invention is to provide sand covered with bentonite having given nature of green sand for facing sand and the pocket sand and a method for making the sand by performing mixing and processing operations in a relatively short period of time.

SUMMARY OF INVENTION

To achieve the objects stated above, the method for making bentonite-covered sand of this invention includes the steps of mixing any of the reproduced sand, new sand, and discarded sand, or a combination of any or all of them with bentonite to make a mixture, and drying the mixture.

The method of this invention for making bentonite-covered sand by mixing reproduced sand and new sand, or one of them with bentonite so as to be used as sand supplement to collected sand includes the steps of mixing reproduced sand and new sand or one of them, floury bentonite, and water having a weight the same as or greater than that of the bentonite to make a mixture, and drying the mixture.

The mixture may include components of bentonite of 4–8% and water of 2% or less after the mixture is dried.

The step of drying the mixture may include a heating operation or a heating and decompressing operation.

The bentonite-covered sand of this invention is made by mixing reproduced sand and new sand or one of them, floury bentonite, and water having a weight the same as or greater than that of the bentonite to make a mixture, so that the reproduced sand and new sand or one of them is covered by the bentonite.

The method and bentonite-covered sand of this invention have the following advantages. According to a prior-art processing method, bentonite is added to supplement the bentonite that is burned during a molding process. The quantity of the bentonite to be supplemented is determined based on the sand that is to be supplied to a mixing process. In contrast, according to a method for processing collected sand of this invention, reproduced sand and new sand or one of them is mixed with at least bentonite, so that supplementary sand can previously be made for the collected sand. The supplementary sand is added to the collected sand. Thus, given molding sand for a mold can be made in a relatively short period of time.

Also, to achieve the objects, the method of this invention for recycling molding sand includes the steps of collecting discarded sand that is discharged from a sand processing line for a molding, reproducing the discarded sand that is collected and mixing the discarded sand with at least bentonite, so that bentonite-covered sand is made, and supplying the bentonite-covered sand to sand collected from a green sand processing line as supplementary sand.

Another method of this invention for recycling molding sand includes the steps of collecting discarded sand that is discharged from a sand processing line for a molding, mixing the discarded sand with at least bentonite, so that bentonite-covered sand is made, and supplying the bentonite-covered sand to sand collected from a green sand processing line as supplementary sand.

Another method of this invention for recycling molding sand includes the steps of collecting discarded sand that is discharged from a green sand processing line, reproducing the discarded sand that is collected and mixing the discarded sand with at least bentonite, so that bentonite-covered sand is made, and supplying the bentonite-covered sand to sand collected from the green sand processing line as supplementary sand.

Also, another method of this invention for recycling molding sand includes the steps of collecting discarded sand that is discharged from a green sand processing line, mixing the discarded sand with at least bentonite, so that bentonite-covered sand is made, and supplying the bentonite-covered sand to sand collected from the green sand processing line as supplementary sand.

The step of making the bentonite-covered sand may include mixing reproduced sand or the discarded sand, floury bentonite, and water having a weight the same as or greater than that of the bentonite to make a mixture, and drying the mixture.

The step of drying the mixture may include a heating operation or a heating and decompressing operation.

The method of this invention for recycling molding sand includes the steps of collecting discarded sand that is discharged from a sand processing line for a molding, mixing discarded sand that is discharged from a molding sand for a mold with at least bentonite, so that bentonite-covered sand is made, and using the bentonite-covered sand as supplementary sand for the molding sand processing line for a mold.

The method of this invention for recycling molding sand includes the steps of mixing the discarded sand that is reproduced with at least bentonite, so that bentonite-covered sand is made, and using the bentonite-covered sand as supplementary sand for a molding sand processing line for a mold.

Also, to achieve the object stated above, bentonite-covered sand can be used for facing sand or the pocket sand. It is made by covering reproduced sand and new sand or one of them with bentonite and simultaneously drying the sand, or by covering reproduced sand and new sand or one of them with bentonite and then drying the sand, so that the bentonite-covered sand is made, and by supplying the bentonite-covered sand to a mixing process.

DETAILED EXPLANATION OF PREFERRED EMBODIMENT

Figure 1:
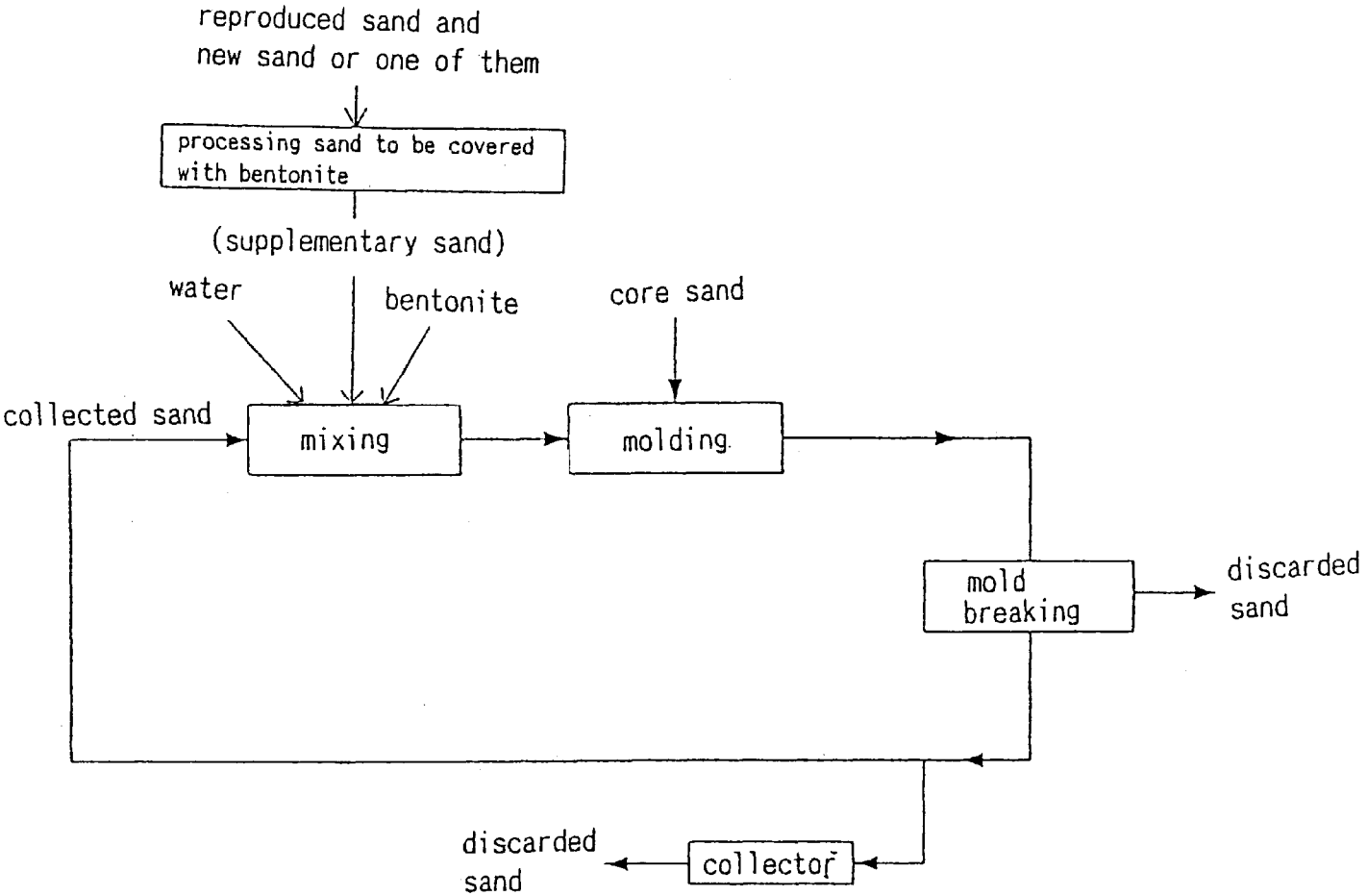
FIG. 1 is a schematic view showing a flow of sand in a sand processing line of this invention.
Figure 2:
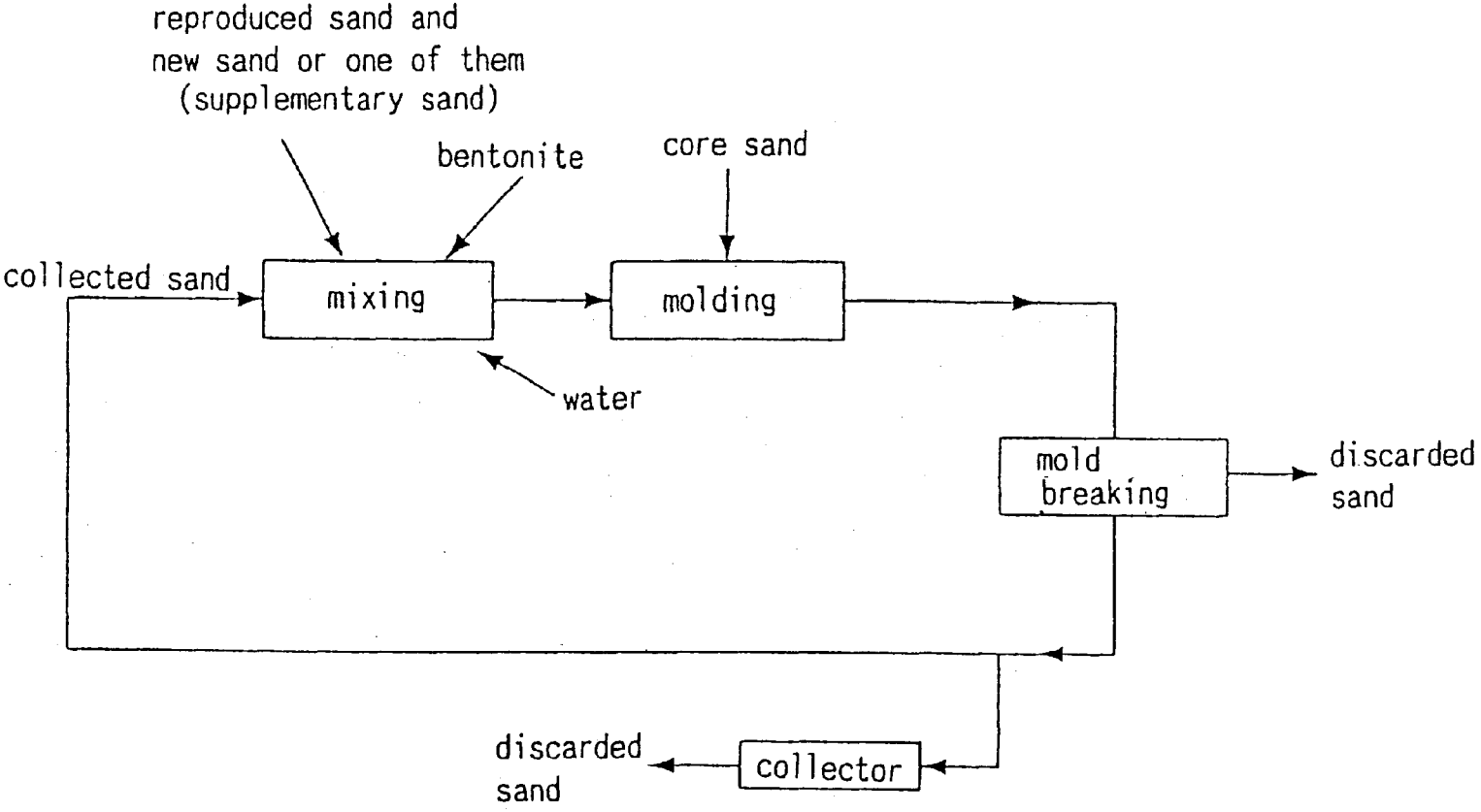
FIG. 2 is a schematic view showing a flow of sand in a sand processing line of prior art.

Throughout this specification the "reproduced sand" is sand from which adhered impurities are removed by a sand-reproducing apparatus. "New sand" includes artificial sand, such as silica sand, zircon sand, and ceramic sand. The kind of sand is no object. In this specification, if we say, "at least bentonite," in addition to bentonite, components that are necessary for green sand for a molding can be included. The "mixing operation" is performed by mixing reproduced sand, etc., bentonite, and water so that the reproduced sand, etc. and bentonite may be uniformly dispersed in water. This mixing operation allows bentonite that holds water to adhere to particles of sand such as reproduced sand, etc. It is desirable that this mixing operation is performed using an agitator-type mixer. But another type of mixer can also be used.

Also, throughout this specification, the "collected sand" means sand that is collected to be reused after a mold is removed. The "supplementary sand" means sand that is to be added to a sand processing line before or at the mixing operation. The "bentonite-covered sand" means sand that is covered with bentonite. The bentonite-covered sand is made by covering discarded sand or sand that is made by processing discarded sand for reuse. Specifically, the bentonite-covered sand is made by supplying bentonite and discarded sand or sand that is made by processing discarded sand to an agitator-type mixer in which a container can be heated. Then, the discarded sand or the sand and the bentonite are mixed for a preset time so that a mixture is obtained. Water that is more in weight than that of the bentonite contained is added to the mixture bit by bit while they are being mixed. Then the container is heated to dry the mixture of the sand and the bentonite.

Floury bentonite of this invention has an activity of 100%. Various kinds of bentonite can be used. Drying a mixture means reducing the amount of water in the mixture. Many methods can be used for the reducing. The bentonite-covered sand may be made for supplementary sand for a molding sand processing line by a manufacturer of it, or by a purchaser of it.

In this specification the "molding sand processing line" means a sand processing line for molding sand to make a mold. Any sand, such as green sand, self-hardening sand, or sand for a shell may be used. The "discarded sand" means sand that is discharged from a molding sand processing line after a mold is removed, such as green sand, or sand for a core. Also, part of the collected sand that is removed to prevent sand for a core from being unnecessarily attached to the molding sand as an impurity is included in the "discarded sand." The "sand reprocessing" means the removal of an impurity that is attached to the sand by using a sand reprocessing apparatus. There are many kinds sand processing apparatuses, such as the dry type, wet type, roast type, etc. Any kind can be used for this invention.

The reason that the step for making the bentonite-covered sand of this invention uses water having a weight that is the same as or more than that of floury bentonite is as follows: At a prior-art mixing step for making green sand for a mold, floury bentonite is added so that the amount of active bentonite may be 7 to 8%, and water is added so that the quantity of water may be 3–4%. The ratio of water to the active bentonite that is comprised of floury bentonite and bentonite that remains is less than 50%. That rate is not above 50% when the bentonite-covered sand is used for green sand for a mold. In contrast, the above condition is desirable so as to uniformly cover sand with bentonite. If the ratio of the weight of water to the floury bentonite is less than 100%, the floury bentonite cannot be uniformly mixed with reproduced sand, etc. in a short period of time.

If the ratio of the weight of water as a percentage of the floury bentonite is extremely large, the mixing and drying operations are difficult. Thus, it is desirable that the ratio of the weight of water is one to three times that of the floury bentonite.

In this invention, the supplementary sand includes the bentonite-covered sand that is made by covering sand with bentonite. That is, it is made by mixing the reproduced sand, etc., the floury bentonite, and water having a weight that is the same as or more than that of the floury bentonite, and then drying the mixture. The mixture includes bentonite of 4–8% and water that is less than 2%.

Taking the efficiency of the mixing operation into consideration, it is desirable that the bentonite-covered sand include bentonite of 5.5%–7.0%. If the rate is less than 5.5%, the leading edge of the resistive pressure becomes low as the rate decreases. If it is greater than 7.0%, the mixing becomes difficult as the rate increases. The quantity of the water is less than 2%, because then the disadvantages of attachment and hardening are reduced. It is more desirable that water of 1.5% is included.

The drying step of this invention uses heating. Thus, the drying step generates the effect by which uniformly covered sand can be obtained in a short period of time in comparison with the case where no heat is used. This heating operation can be achieved by, for example, supplying heated air, heating the container of the mixer, etc.

At the drying step of this invention, the heating operation and the pressure reduction are performed, so that air is expelled from the space between particles of sand and bentonite. Thus, uniform and hard bentonite-covered sand can be made in a short period of time in comparison with the case when no pressure reduction is performed.

EXAMPLE 1

FIG. 1 shows an embodiment of a sand processing line of this invention. As in FIG. 1, the sand processing line includes a cycle having a mixing process and a mold breaking process. A mixer is separately located from the sand processing line to make the bentonite-covered sand. The mixer operates heating and pressure-reducing functions.

New and natural silica sand yielded in Australia and Na-type floury bentonite yielded in the U.S. are supplied to an agitator-type mixer that can be heated, and then mixed by it for about one minute to make a mixture. Then, water having a weight the same as or more than that of the bentonite is added to the mixture bit by bit during the mixing operation. Also, the container of the mixer is heated by 120 degrees to dry the mixture of the natural silica sand, the bentonite, and the water. This results in bentonite-covered sand having bentonite of 6% and water of 2%. When the mixture was mixed with the water, a roller-type mixer could not mix them.

Then, the bentonite-covered sand whose ratio of the weight to that of the collected sand is 10% is added as supplementary sand to collected sand that is retrieved from the green sand processing line. Also, floury bentonite and water having a given quantity are added to the collected sand. They are mixed by a Simpson mixer having rollers. A plurality of masses of the mixed sand sampled at the beginning of the mixing operation are tested to measure resistive pressures.

Also, a prior-art method was performed to add the natural silica sand to the collected sand. Also, floury bentonite and water having a given quantity were added to the collected sand. Then, they were supplied to a mixer and mixed by it. The same operations and the test were performed on the mixture obtained by this prior-art method.

In comparison with a result of the prior-art method, it is found that the use of the bentonite-covered sand of this invention as supplementary sand allows the mixing operation to rapidly be achieved and the high resistive pressure to be obtained. When the surfaces of particles of sand are observed by a scanning electron microscope, it is found that the surfaces are more uniformly covered by the use of the bentonite-covered sand than was the case by the prior-art method.

EXAMPLE 2

Masses of green sand that were discharged from the sand processing line were supplied to a sand reproducer to remove attachments from the surfaces of particles of sand, so that reproduced sand could be made. Then, the reproduced sand was used, instead of the new and natural silica sand stated above in Example 1, and processed as in the case in Example 1. The results were compared with those of Example 1. They were favorable.

EXAMPLE 3

No heat was used during the process of covering sand with bentonite. Like Example 1, the covering process could be achieved. But, it took longer than in the case of Example 1.

The method for making the bentonite-covered sand in these examples includes the step of mixing the reproduced sand and new sand or one of them with the bentonite, so that the mixture can be used as supplementary sand to be added to the collected sand. According to this method, the reproduced sand and the new sand or one of them, floury bentonite, and water having a weight the same as or more than that of the floury bentonite are mixed and dried, so that the supplementary sand can be made. When the supplementary sand is added to the collected sand, green sand for a mold can be made by merely mixing them for a relatively short time. This effect is very valuable for this industry.

Figure 3:
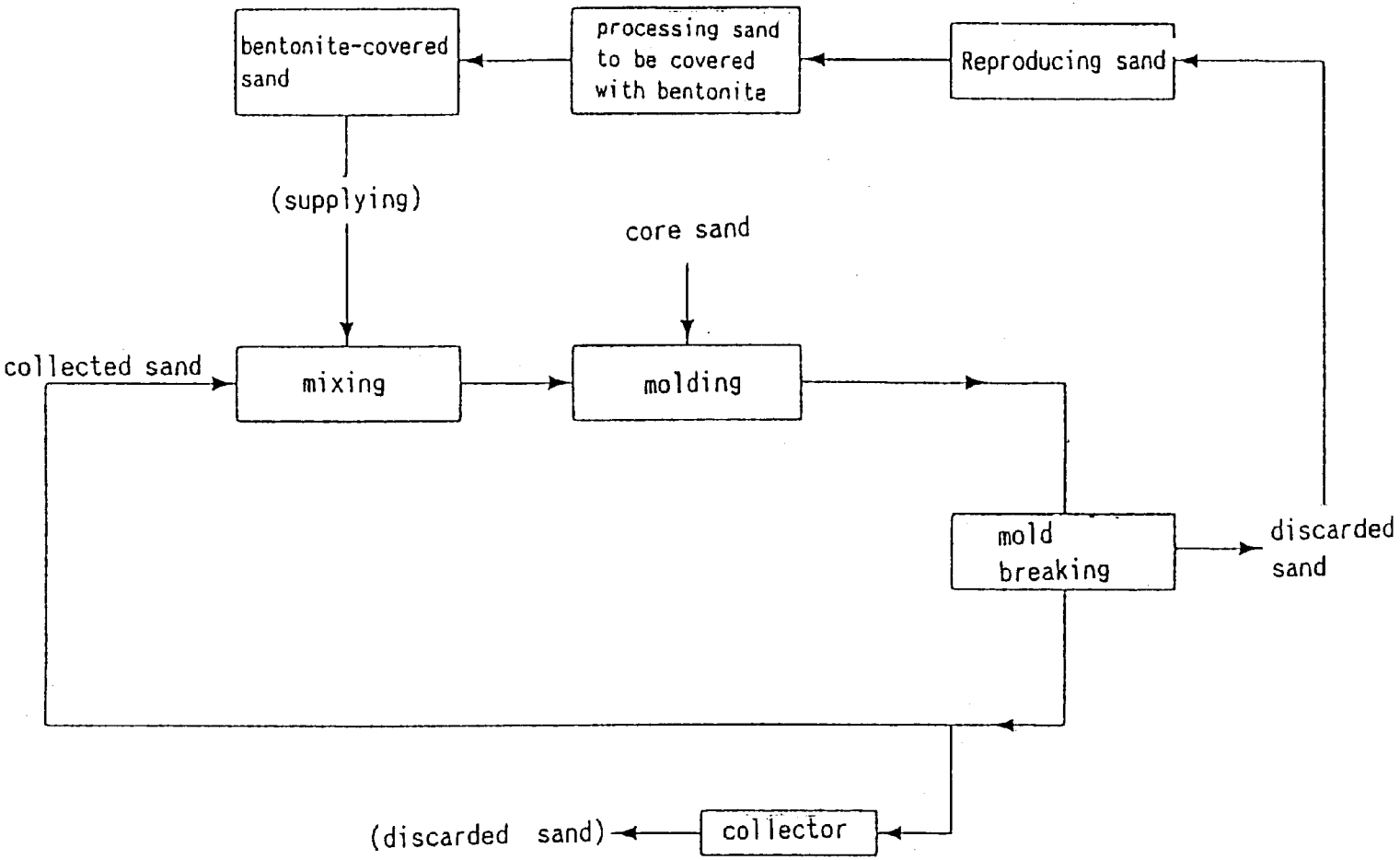
FIG. 3 is a schematic view of an embodiment of this invention showing a flow of sand where molding sand is recycled.
Figure 4:
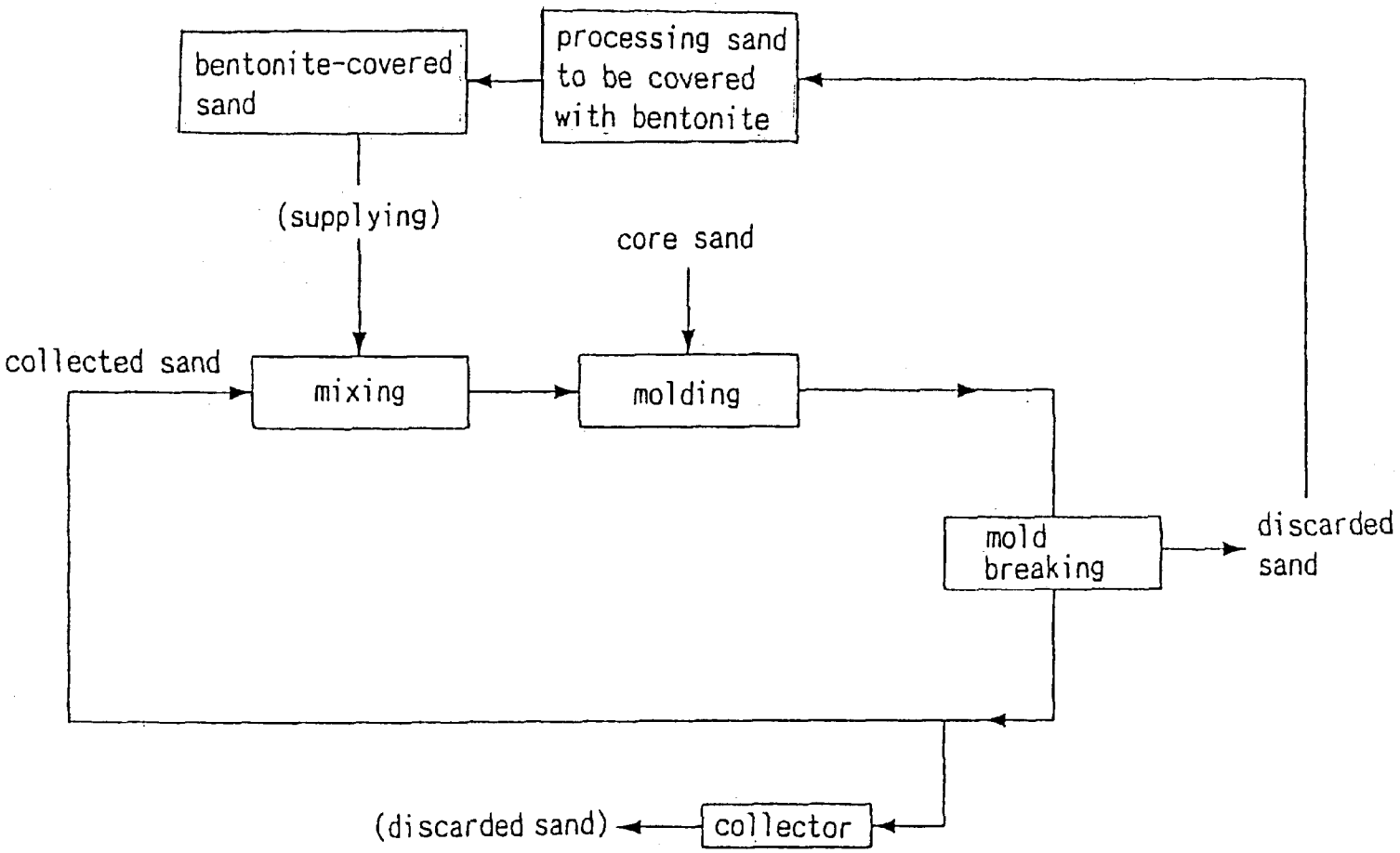
FIG. 4 is a schematic view of another embodiment of this invention showing a flow of sand where molding sand is recycled.

Based on FIGS. 3 and 4, Example 4 of this invention is explained.

EXAMPLE 4

As in FIG. 3, when a mold is broken, much sand forming the mold is collected and returned to the mixing process. The sand that is not collected is sent as discarded sand to the sand reproducing process, so that it is reprocessed by a sand reproducing apparatus. The discarded sand that is collected by a collector located in the green sand processing line is finely floury. Thus, it is not used for the bentonite-covered sand of this invention, but is used as a material for road beds, etc., or is recycled, or is finally discarded.

Impurities that are adhered to the particles of the discarded sand are removed by the sand reproducing apparatus. The discarded sand is sent to the process to make the bentonite-covered sand. The bentonite-covered sand is sent to the mixing process of the green sand processing line. Then, the bentonite-covered sand is sent to the apparatus performing the mixing process, and mixed there with the collected sand by the mixer, so that a given molding sand for a mold is made. It is sent to the molding apparatus to make a mold that has the desired nature.

As in FIG. 4, the discarded sand that is collected and selected may be directly supplied to the apparatus performing the process to make the bentonite-covered sand without reproducing the discarded sand. This is one of the embodiments of this invention. In that case, the sand reproducing process is unnecessary. Thus, the cost can be decreased and the time necessary to process the discarded sand can be shortened. However, the quality of the bentonite-covered sand is worse than in the case when the reproduced sand from the discarded sand is used.

The method of this invention for recycling the molding sand for a mold uses the bentonite-covered sand that is made by corporations reproducing discarded sand. Manufacturers of molds carry on business in discarded sand with corporations. It is possible for the corporations to purchase the discarded sand and make the bentonite-covered sand. Alternatively, when the discarded sand is transferred in the course of business between the manufacturers of molds and any of the corporations, the owners of the processing line for green sand, and vendors of materials for molds, the manufacturers may provide the discarded sand to the corporations for reproducing sand, if the manufacturers do not have any sand reproducing apparatus. Also, the manufacturers may make the bentonite-covered sand from the reproduced sand. In that case, if necessary, before the process of covering bentonite, the discarded sand may be processed by the sand reproducing apparatus.

Also, it is possible that the manufacturers reprocess the discarded sand, and then sell the resulting sand to manufacturers of the bentonite-covered sand so as to enable the manufacturers to make the bentonite-covered sand.

According to this embodiment, the discarded sand that is discharged from the molding sand processing line for a mold that includes a green sand processing line, etc. is mixed with at least bentonite to make the bentonite-covered sand. Then, the bentonite-covered sand is supplied to the green sand processing line as supplementary sand. Thus, the nature of the sand for the green sand processing line can be controlled for a short period of time. Also, the discarded sand that was previously considered to be merely discarded can be used effectively.

Also, the mixture having the bentonite-covered sand can be used as facing sand and the pocket sand. The bentonite-covered sand is made by a known mixer by mixing reproduced sand and new sand or one of them, floury sand, and water having a weight the same as or more than that of the floury bentonite, and then drying this mixture. The mixture includes bentonite of 4–8% and water of 2% or less. The drying process is performed when or after the sand is covered with the bentonite.

If the amount of water is excessively greater than that of bentonite, the mixing and drying operations become difficult. Thus, it is desirable that the weight of the water is one to three times that of the bentonite. The reproduced sand is made by reproducing any kind of molding sand, such as green sand, core sand, and self-hardening sand, and removing impurities, such as bonds, from surfaces of particles of sand.

EXAMPLE 5

New, natural silica sand yielded in Australia and Na-type floury bentonite yielded in the U.S. are mixed by an agitator-type mixer for about one minute to make a mixture. Then, water having a weight the same as or more than that of the bentonite is added to the mixture bit by bit during the mixing operation. Also, the container of the mixer is heated at approximately 100 degrees to dry the mixture of the natural silica sand and the bentonite. This results in the bentonite-covered sand having bentonite of 6% and water of 2%. Then, water having a given quantity is added to the bentonite-covered sand. They are mixed by a known mixer, i.e., a Simpson-type mixer having rollers. Then, a plurality of masses of the mixed sand sampled at the beginning of the mixing operation are tested to measure the resistive pressures. Also, natural silica sand, floury bentonite, and water are mixed by the mixer and processed as stated above. It is found that the use of the mixture of the bentonite-covered sand allows the mixing operation to rapidly be achieved and the high resistive pressure to be obtained.

Figure 5:
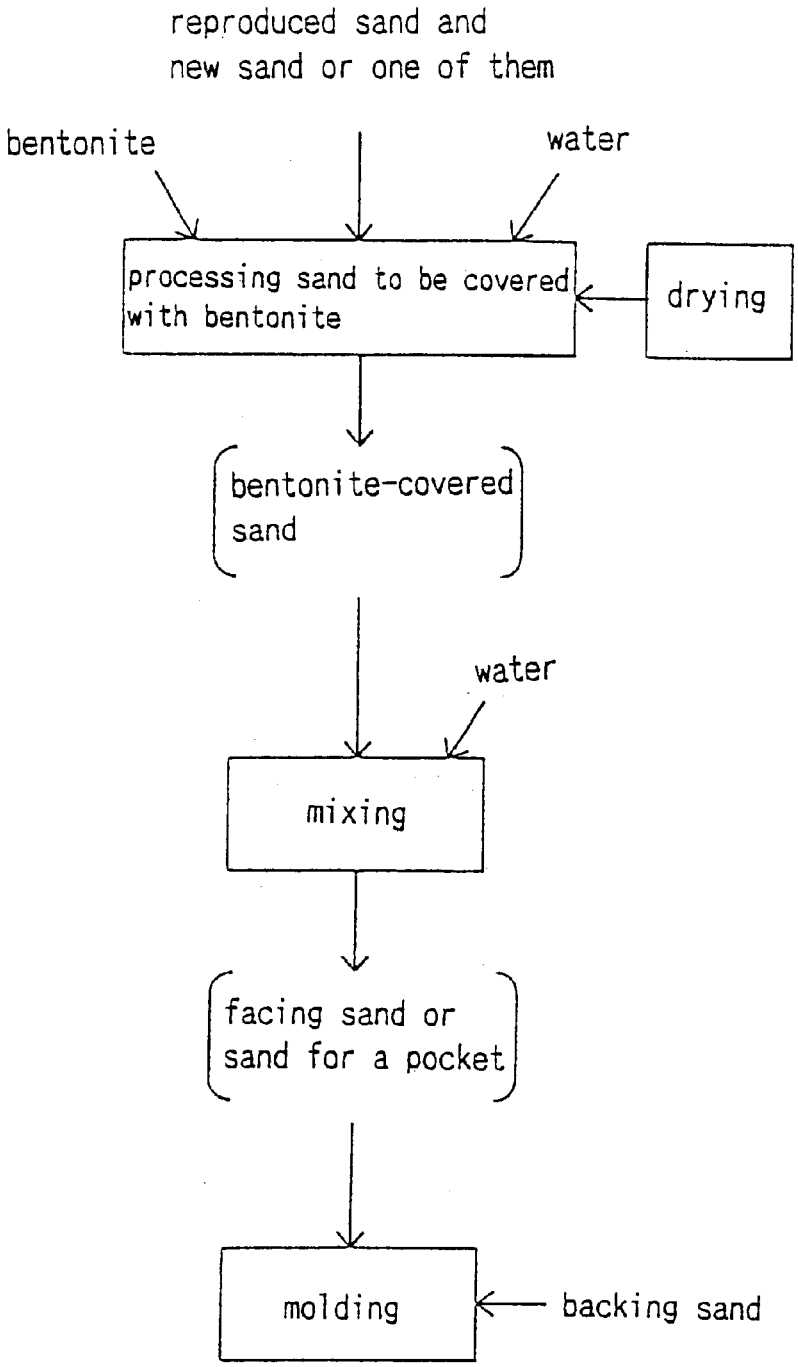
FIG. 5 is a schematic view showing an embodiment of this invention where the bentonite-covered sand is mixed with water and used for facing sand or the pocket sand.

As in FIG. 5, the collected sand that was collected from the line was used as backing sand. Also, the bentonite and water were mixed. It was found that favorable results could be obtained when the sand mixed was used as facing sand or sand for a pocket ("pocket sand").

EXAMPLE 6

Masses of green sand that were discharged by a screen from the sand processing line were supplied to a sand reproducer of a roller type to remove attachments from the surfaces of particles of sand, so that reproduced sand could be made. Then, the reproduced sand was used, instead of the new, natural silica sand stated above in Example 5, and this was processed as in the case in Example 5. The results were compared with those in Example 5. They were favorable.

EXAMPLE 7

New silicon sand was used, instead of the new and natural silica sand mentioned above in Example 5, and was processed as in the case in Example 5. The results were compared with those of Example 5. They were favorable.

The bentonite-covered sand used in this example can be made merely by covering reproduced sand and new sand or one of them with bentonite, drying it during or after that covering operation, and then making the mixture of the bentonite-covered sand in a short period of time. This mixture can be used for facing sand or the pocket sand. Thus, the given nature of green sand can be obtained simply.

What is claimed is:

1. A method for making bentonite-covered sand by mixing reproduced sand and new sand, or one of them with bentonite so as to be used as sand supplement to collected sand, including the steps of mixing reproduced sand and new sand or one of them, floury bentonite, and water having a weight the same as or greater than that of the bentonite to make a mixture, and drying the mixture.

2. The method of claim 1 wherein the mixture includes components of bentonite of 4–8% and water of 2% or less after the mixture is dried.

3. The method of claim 1 wherein the step for drying the mixture includes a heating operation or a heating and decompressing operation.

4. Bentonite-covered sand that is made by mixing reproduced sand and new sand or one of them, floury bentonite, and water having a weight the same as or greater than that of the bentonite to make a mixture, so that the reproduced sand and new sand or one of them is covered by the bentonite.

5. A method for recycling molding sand including the steps of collecting discarded sand that is discharged from a sand processing line for a molding, reproducing the discarded sand that is collected and mixing the discarded sand with at least bentonite, so that bentonite-covered sand is made, and supplying the bentonite-covered sand to sand collected from a green sand processing line as supplementary sand.

6. A method for recycling molding sand including the steps of collecting discarded sand that is discharged from a sand processing line for a molding, mixing the discarded sand with at least bentonite, so that bentonite-covered sand is made, and supplying the bentonite-covered sand to sand collected from a green sand processing line as supplementary sand.

7. A method for recycling molding sand including the steps of collecting discarded sand that is discharged from a green sand processing line, reproducing the discarded sand that is collected and mixing the discarded sand with at least bentonite, so that bentonite-covered sand is made, and supplying the bentonite-covered sand to sand collected from the green sand processing line as supplementary sand.

8. A method for recycling molding sand including the steps of collecting discarded sand that is discharged from a green sand processing line, mixing the discarded sand with at least bentonite, so that bentonite-covered sand is made, and supplying the bentonite-covered sand to sand collected from the green sand processing line as supplementary sand.

9. The method for recycling of any of claims 5 to 8 wherein the step of making the bentonite-covered sand includes mixing reproduced sand or the discarded sand, floury bentonite, and water having a weight the same as or greater than that of the bentonite to make a mixture, and drying the mixture.

10. The method of claim 9 wherein the step of drying the mixture includes a heating operation or a heating and decompressing operation.

11. A method for recycling molding sand including the steps of collecting discarded sand that is discharged from a sand processing line for a molding, mixing discarded sand that is discharged from a molding sand for a mold with at least bentonite, so that bentonite-covered sand is made, and using the bentonite-covered sand as supplementary sand for the molding sand processing line for a mold.

12. A method for recycling molding sand including the steps of mixing the discarded sand that is reproduced with at least bentonite, so that bentonite-covered sand is made, and using the bentonite-covered sand as supplementary sand for a molding sand processing line for a mold.

13. Bentonite-covered sand used for facing sand or sand for a pocket made by covering reproduced sand and new sand or one of them with bentonite and simultaneously drying the sand, or by covering reproduced sand and new sand or one of them with bentonite and then drying the sand, so that the bentonite-covered sand is made, and by supplying the bentonite-covered sand to a mixing process.

14. A method for using bentonite-covered sand for facing sand or sand for a pocket made by covering reproduced sand and new sand or one of them with bentonite and simultaneously drying the sand, or by covering reproduced sand and new sand or one of them with bentonite and then drying the sand, so that the bentonite-covered sand is made, and by supplying the bentonite-covered sand to a mixing process, characterized by using the bentonite-covered sand that is supplied to the mixing process for facing sand or the pocket sand.

15. The method of claim 14 wherein the bentonite-covered sand is made by mixing reproduced sand and new sand or one of them, floury bentonite, and water having a weight the same as or greater than that of the floury bentonite to make a mixture, and drying the mixture.

16. The method of claim 15 wherein the step of drying the mixture includes a heating operation or heating and decompressing operations.

* * * * *